US010750916B2

(12) United States Patent
Dyson et al.

(10) Patent No.: US 10,750,916 B2
(45) Date of Patent: Aug. 25, 2020

(54) CYCLONIC SEPARATOR

(71) Applicant: Dyson Technology Limited, Wiltshire (GB)

(72) Inventors: James Dyson, Bristol (GB); Jeremy William Crouch, Swindon (GB); James Stuart Robertson, Bath (GB); Peter David Gammack, Gloucester (GB); Simon Edward Ireland, Tonbridge (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 373 days.

(21) Appl. No.: 15/915,698

(22) Filed: Mar. 8, 2018

(65) Prior Publication Data

US 2018/0199775 A1 Jul. 19, 2018

Related U.S. Application Data

(63) Continuation of application No. 14/111,985, filed as application No. PCT/GB2012/050840 on Apr. 16, 2012, now Pat. No. 9,918,602.

(30) Foreign Application Priority Data

Apr. 15, 2011 (GB) ..... 1106454.0
Apr. 15, 2011 (GB) ..... 1106455.7

(51) Int. Cl.
*A47L 9/16* (2006.01)
*A47L 9/20* (2006.01)
(Continued)

(52) U.S. Cl.
CPC ..... *A47L 9/1641* (2013.01); *A47L 9/1608* (2013.01); *A47L 9/1666* (2013.01); *A47L 9/20* (2013.01);
(Continued)

(58) Field of Classification Search
CPC .... A47L 9/1608; A47L 9/1625; A47L 9/1633; A47L 9/1641; A47L 9/165; A47L 9/1658;
(Continued)

(56) References Cited

U.S. PATENT DOCUMENTS 2,731,102 A 1/1956 James
4,373,228 A 2/1983 Dyson
(Continued)

FOREIGN PATENT DOCUMENTS

CN 101961226 2/2011
EP 1 676 517 7/2006
(Continued)

OTHER PUBLICATIONS

International Search Report and Written Opinion dated Jul. 12, 2012, directed to International Application No. PCT/GB2012/050840; 9 pages.
(Continued)

*Primary Examiner* — Joseph J Hail
*Assistant Examiner* — Arman Milanian
(74) *Attorney, Agent, or Firm* — Morrison & Foerster LLP

(57) ABSTRACT

A cyclonic separator comprising a cyclone chamber defined between an outer wall and a shroud. The shroud comprises an inlet opening through which fluid enters the cyclone chamber, and a plurality of perforations through which fluid exits the cyclone chamber. Fluid within the cyclone chamber is then free to spiral about the shroud and over the inlet opening.

16 Claims, 11 Drawing Sheets

(51) Int. Cl.
*B04C 5/28* (2006.01)
*B04C 9/00* (2006.01)
*B04C 5/12* (2006.01)

(52) U.S. Cl.
CPC ..... *B04C 5/12* (2013.01); *B04C 5/28* (2013.01); *A47L 9/165* (2013.01); *A47L 9/1658* (2013.01); *B04C 2009/004* (2013.01)

(58) Field of Classification Search
CPC ... A47L 9/1666; A47L 9/20; B04C 2009/004; B04C 5/28
See application file for complete search history.

(56) References Cited

U.S. PATENT DOCUMENTS

| | | | | |
|---|---|---|---|---|
| 6,192,550 | B1 | 2/2001 | Hamada et al. | |
| 6,221,134 | B1 * | 4/2001 | Conrad | A47L 9/1608 55/426 |
| 6,334,234 | B1 | 1/2002 | Conrad et al. | |
| 6,344,064 | B1 | 2/2002 | Conrad | |
| 6,406,505 | B1 | 6/2002 | Oh et al. | |
| 6,440,197 | B1 * | 8/2002 | Conrad | A47L 9/1608 55/418 |
| 6,502,278 | B2 | 1/2003 | Oh et al. | |
| 6,868,578 | B1 | 3/2005 | Kasper et al. | |
| 7,065,826 | B1 | 6/2006 | Arnold | |
| 7,294,159 | B2 | 11/2007 | Oh et al. | |
| 7,335,241 | B2 | 2/2008 | Oh et al. | |
| 7,335,242 | B2 | 2/2008 | Oh | |
| 7,497,899 | B2 | 3/2009 | Han et al. | |
| 7,547,351 | B2 | 6/2009 | Oh et al. | |
| 7,556,662 | B2 | 7/2009 | Lee et al. | |
| 7,563,298 | B2 | 7/2009 | Oh | |
| 7,582,129 | B2 | 9/2009 | Kim et al. | |
| 7,662,201 | B2 | 2/2010 | Lee | |
| 7,722,709 | B2 | 5/2010 | Conrad | |
| 7,785,383 | B2 | 8/2010 | Oh et al. | |
| 7,867,307 | B2 | 1/2011 | Bates et al. | |
| 7,996,956 | B2 | 8/2011 | Wood et al. | |
| 8,152,878 | B2 | 4/2012 | McLeod | |
| 8,434,193 | B2 | 5/2013 | Sunderland et al. | |
| 8,516,652 | B2 | 8/2013 | Sunderland et al. | |
| 9,237,834 | B2 | 1/2016 | Gammack et al. | |
| 2003/0200622 | A1 | 10/2003 | Park et al. | |
| 2004/0139573 | A1 | 7/2004 | Stephens et al. | |
| 2006/0048487 | A1 | 3/2006 | Song et al. | |
| 2006/0117721 | A1 | 6/2006 | Lee et al. | |
| 2006/0123590 | A1 | 6/2006 | Fester et al. | |
| 2006/0230718 | A1 | 10/2006 | Han et al. | |
| 2006/0230721 | A1 | 10/2006 | Oh et al. | |
| 2006/0254226 | A1 | 11/2006 | Jeon | |
| 2007/0079473 | A1 | 4/2007 | Min et al. | |
| 2007/0079582 | A1 | 4/2007 | Oh | |
| 2007/0079586 | A1 | 4/2007 | Kim | |
| 2007/0079587 | A1 | 4/2007 | Kim | |
| 2007/0084160 | A1 | 4/2007 | Kim | |
| 2007/0119129 | A1 * | 5/2007 | Jeon | A47L 9/1658 55/337 |
| 2007/0214754 | A1 | 9/2007 | Kim | |
| 2008/0190080 | A1 | 8/2008 | Oh et al. | |
| 2008/0264017 | A1 | 10/2008 | Oh et al. | |
| 2008/0271284 | A1 | 11/2008 | Wood et al. | |
| 2009/0178567 | A1 | 7/2009 | Han et al. | |
| 2009/0205162 | A1 | 8/2009 | Oh et al. | |
| 2009/0211212 | A1 | 8/2009 | Hyun et al. | |
| 2009/0282639 | A1 | 11/2009 | Dyson et al. | |
| 2009/0282791 | A1 | 11/2009 | Lang | |
| 2010/0083833 | A1 | 4/2010 | Morphey | |
| 2010/0089014 | A1 | 4/2010 | Zhou | |
| 2010/0242208 | A1 | 9/2010 | Gammack et al. | |
| 2011/0016659 | A1 | 1/2011 | Dyson et al. | |
| 2011/0219733 | A1 | 9/2011 | Greene | |
| 2014/0047667 | A1 | 2/2014 | Robertson et al. | |
| 2014/0053365 | A1 | 2/2014 | Gammack et al. | |
| 2014/0053368 | A1 | 2/2014 | Gammack et al. | |
| 2014/0101888 | A1 | 4/2014 | Mantell et al. | |

FOREIGN PATENT DOCUMENTS

| | | |
|---|---|---|
| EP | 1 726 245 | 11/2006 |
| EP | 1 772 091 | 4/2007 |
| EP | 1 774 890 | 4/2007 |
| EP | 1 779 760 | 7/2008 |
| EP | 1 952 744 | 8/2008 |
| EP | 1 961 356 | 8/2008 |
| GB | 2 255 296 | 11/1992 |
| GB | 2 296 879 | 7/1996 |
| GB | 2 424 605 | 10/2006 |
| GB | 2 448 915 | 11/2008 |
| GB | 2 450 736 | 1/2009 |
| GB | 2 453 760 | 4/2009 |
| GB | 2469045 | 10/2010 |
| GB | 2469057 | 10/2010 |
| GB | 2487398 | 7/2012 |
| JP | 10-511880 | 11/1998 |
| JP | 2002-51952 | 2/2002 |
| JP | 2003-180585 | 7/2003 |
| JP | 2003-211025 | 7/2003 |
| JP | 2006-88139 | 4/2006 |
| JP | 2006-150037 | 6/2006 |
| JP | 2007-105451 | 4/2007 |
| JP | 2008-272474 | 11/2008 |
| JP | 2009-95678 | 5/2009 |
| JP | 2010-201167 | 9/2010 |
| JP | 2010-227287 | 10/2010 |
| JP | 2010-240441 | 10/2010 |
| JP | 2011-36447 | 2/2011 |
| KR | 10-0598600 | 7/2006 |
| KR | 10-2009-0130244 | 12/2009 |
| WO | WO-2009/050430 | 4/2009 |
| WO | WO-2010/044541 | 4/2010 |

OTHER PUBLICATIONS

Search Report dated Aug. 16, 2012, directed to GB Application No. 1206661.9; 1 page.
Gammack et al., U.S. Office Action dated Jan. 26, 2015, directed to U.S. Appl. No. 14/111,990; 7 pages.
Gammack et al., U.S. Office Action dated Mar. 4, 2016, directed to U.S. Appl. No. 14/111,926; 7 pages.
Robertson et al., U.S. Office Action dated Jan. 27, 2015, directed to U.S. Appl. No. 14/111,937; 6 pages.
Robertson et al., U.S. Office Action dated Sep. 8, 2015, directed to U.S. Appl. No. 14/111,937; 5 pages.
Robertson et al., U.S. Office Action dated Dec. 30, 2015, directed to U.S. Appl. No. 14/111,937; 6 pages.
Dyson et al., U.S. Office Action dated Apr. 28, 2016, directed to U.S. Appl. No. 14/111,985; 13 pages.
Dyson et al., U.S. Office Action dated Oct. 26, 2016, directed to U.S. Appl. No. 14/111,985; 9 pages.
Dyson et al., U.S. Office Action dated Feb. 27, 2017, directed to U.S. Appl. No. 14/111,985; 10 pages.
Dyson et al., U.S. Office Action dated Jul. 27, 2017, directed to U.S. Appl. No. 14/111,985; 10 pages.
Notification of Reason for Rejection dated Jan. 10, 2019, directed to JP Application No. 2016-133384; 6 pages.

* cited by examiner

CYCLONIC SEPARATOR

REFERENCE TO RELATED APPLICATIONS

This application is a continuation of U.S. patent application Ser. No. 14/111,985, filed Nov. 7, 2013, which is a national stage application under 35 USC 371 of International Application No. PCT/GB2012/050840, filed Apr. 16, 2012, which claims the priority of United Kingdom Application No. 1106454.0, filed Apr. 15, 2011, and United Kingdom Application No. 1106455.7, filed Apr. 15, 2011, each of which is incorporated herein by reference in its entirety.

FIELD OF THE INVENTION

The present invention relates to a cyclonic separator and to a vacuum cleaner incorporating the same.

BACKGROUND OF THE INVENTION

Vacuum cleaners having a cyclonic separator are now well known. Efforts are continually being made to improve the separation efficiency of the separator.

SUMMARY OF THE INVENTION

In a first aspect, the present invention provides a cyclonic separator comprising a cyclone chamber defined between an outer wall and a shroud, the shroud comprising an inlet opening through which fluid enters the cyclone chamber, and a plurality of perforations through which fluid exits the cyclone chamber, wherein fluid within the cyclone chamber is free to spiral about the shroud and over the inlet opening.

In a conventional cyclonic separator, fluid is typically introduced tangentially via an inlet in the outer wall. The shroud then presents a first line-of-sight for fluid introduced into the cyclone chamber. As a result, dirt smaller than the shroud perforations will pass immediately through the shroud, resulting in a drop in separation efficiency. By locating the inlet opening at the shroud, fluid is introduced into the cyclone chamber in a direction away from the shroud. As a result, the first line-of sight for the fluid is the outer wall. The direct route through the shroud is therefore eliminated and a net increase in separation efficiency is observed.

The inlet opening may introduce fluid into to an upper part of the cyclone chamber, and the cyclonic separator may comprise a dirt collection chamber located below the cyclone chamber. Fluid then spirals in a direction that generally descends within the cyclone chamber. Dirt separated from the fluid then collects in the first dirt collection chamber located below the cyclone chamber. By introducing fluid into an upper part of the cyclone chamber, the spiralling fluid helps to sweep dirt off the shroud and into the dirt collection chamber.

The cyclonic separator may comprise an inlet duct for carrying fluid to the cyclone chamber, and the inlet duct may terminate at the inlet opening. This then results in a relatively compact and streamlined cyclonic separator. In particular, the inlet duct may extend through the interior of the cyclonic separator, thereby avoiding the need for external ducting. In terminating at the shroud, the inlet duct does not project into the cyclone chamber. This then has the advantage that the inlet duct does not interfere adversely with fluid spiralling within the cyclone chamber.

Where the cyclonic separator comprises a dirt collection chamber located below the cyclone chamber, the dirt collection chamber may surround a lower part of the inlet duct and the shroud may surround an upper part of the inlet duct. Again, this results in a relatively compact and streamlined product.

The inlet duct may comprise a first section for carrying fluid in a direction parallel to a longitudinal axis of the cyclone chamber, and a second section for turning the fluid and introducing the fluid into the cyclone chamber. This then enables fluid to be carried through the cyclone chamber in a manner that minimises, or indeed prevents, the inlet duct from interfering adversely with the fluid spiralling within the cyclone chamber. In particular, the inlet duct may extend upwardly from the base or downwardly the top of the cyclonic separator before turning and introducing fluid into the cyclone chamber.

The juncture of the inlet duct and the shroud defines an upstream edge and a downstream edge relative to the direction of fluid flow within the cyclone chamber. The upstream edge may be sharp and the downstream edge may be rounded. As a result, fluid is turned further by the inlet duct on entering the cyclone chamber. This then reduces turbulence at the inlet opening and increases the speed of fluid within the cyclone chamber.

The inlet duct may extend from an opening in the base of the cyclonic separator to the inlet opening. By providing an opening in the base of the cyclonic separator, a less tortuous path may be taken by fluid carried to the cyclonic separator. For example, when the cyclonic separator is employed in an upright vacuum cleaner, the cleaner head is generally located below the cyclonic separator. Accordingly, the ducting responsible for carrying fluid from the cleaner head to the cyclonic separator may take a less tortuous path, thereby resulting in improved performance. Alternatively, when the cyclonic separator is employed in a canister vacuum cleaner, the cyclonic separator may be arranged such that the base of the cyclonic separator is directed towards the front of the vacuum cleaner. The ducting responsible for carrying fluid to the cyclonic separator may then be used to manoeuvre the vacuum cleaner. For example, the ducting may be pulled in order to move the vacuum cleaner forwards. Moreover, the ducting may take a less tortuous path thus improving performance. In particular, the ducting need not bend around the base of the cyclonic separator.

The cross-sectional area of the inlet duct may decrease in a direction towards the inlet opening. In terminating the inlet duct at the shroud, fluid is introduced into the cyclone chamber at a non-tangential angle. Accordingly, some loss in fluid speed may occur as the fluid enters the cyclone chamber and collides with the outer wall. By decreasing the cross-sectional area of the inlet duct at the inlet opening, the fluid is accelerated prior to entering the cyclone chamber. This then helps to compensate for the potential loss of fluid speed.

At least part of the inlet duct may be formed integrally with the shroud. As a result, less material is required for the cyclonic separator, thereby reducing the cost and/or weight of the cyclonic separator.

The cyclonic separator may comprise a first cyclone stage and a second cyclone stage located downstream of the first cyclone stage. The first cyclone stage may comprise the cyclone chamber, and the second cyclone stage may comprise a plurality of cyclone bodies. The cyclonic separator may then comprise an inlet duct for carrying fluid to the cyclone chamber, the inlet duct extending between two adjacent cyclone bodies and terminating at the inlet opening. By employing an inlet duct that extends between two of the cyclone bodies, a relatively compact cyclonic separator may be realised. In particular, where the cyclone bodies are located above the cyclone chamber, the cyclone bodies may project into the interior delimited by the shroud so as to reduce the height of the cyclonic separator. The inlet duct may then extend between two of the cyclone bodies such that fluid may be introduced into an upper part of the cyclone chamber without the need to increase the height of the cyclonic separator.

The cyclonic separator may comprise a first cyclone stage and a second cyclone stage located downstream of the first cyclone stage. The first cyclone stage may comprise the cyclone chamber and a first dirt collection chamber located below the cyclone chamber, and the second cyclone stage may comprise a plurality of cyclone bodies and a second dirt collection chamber. The first dirt collection chamber then surrounds the second dirt collection chamber. The first cyclone stage is intended to remove relatively large dirt from fluid admitted to the cyclonic separator. The second cyclone stage, which is located downstream of the first cyclone stage, is then intended to remove smaller dirt from the fluid. Since the first dirt collection chamber surrounds the second dirt collection chamber, a relatively large volume may be achieved for the first dirt collection chamber whilst maintaining a relatively compact overall size for the cyclonic separator.

The cyclonic separator may comprise an inlet duct for carrying fluid to the cyclone chamber, and the inlet duct may terminate at the inlet opening. The first dirt collection chamber then surrounds a lower part of the inlet duct and the shroud surrounds an upper part of the inlet duct. Since the first dirt collection chamber surrounds part of the inlet duct and the second dirt collection chamber, a relatively compact and streamlined cyclonic separator may be realised. In particular, the inlet duct may extend through the interior of the cyclonic separator such that there is no external ducting.

The cyclonic separator may comprise an outlet duct for carrying fluid from the second cyclone stage, and the first cyclone stage may surround at least part of the outlet duct. For example, the outlet duct may extend axially through the cyclonic separator. By extending through the cyclonic separator such that the first cyclone stage surrounds the outlet duct, a relatively compact cyclonic separator may be realised. In particular, the inlet duct and the outlet duct may extend through the interior of the cyclonic separator, such that no external ducting is required to carry fluid along the length of the cyclonic separator. Alternatively, the outlet duct may include a section that extends axially through the cyclonic separator. A filter or the like may then be located within the outlet duct. Again, this provides a compact arrangement since the filter may be located wholly within the cyclonic separator.

The cyclonic separator may comprise an elongate filter located in the outlet duct. Dirt that has not been separated from the fluid by the first and second cyclone stages may then be removed by the filter. In employing an elongate filter, a relatively large surface area may be achieved for the filter.

The filter may comprise a hollow tube that is open at one end and closed at an opposite end, and fluid from the second cyclone stage enters the interior of the filter via the open end and passes through the filter into the outlet duct. As a result, the fluid acts to inflate the filter and thus prevent the filter from collapsing. It is not therefore necessary for the filter to include a frame or other support structure to retain the shape of the filter.

In a second aspect, the present invention provides a vacuum cleaner comprising a cyclonic separator as described in any one of the preceding paragraphs.

BRIEF DESCRIPTION OF THE DRAWINGS

In order that the present invention may be more readily understood, embodiments of the invention will now be described, by way of example, with reference to the accompanying drawings, in which.

DETAILED DESCRIPTION OF THE INVENTION

Figure 1:
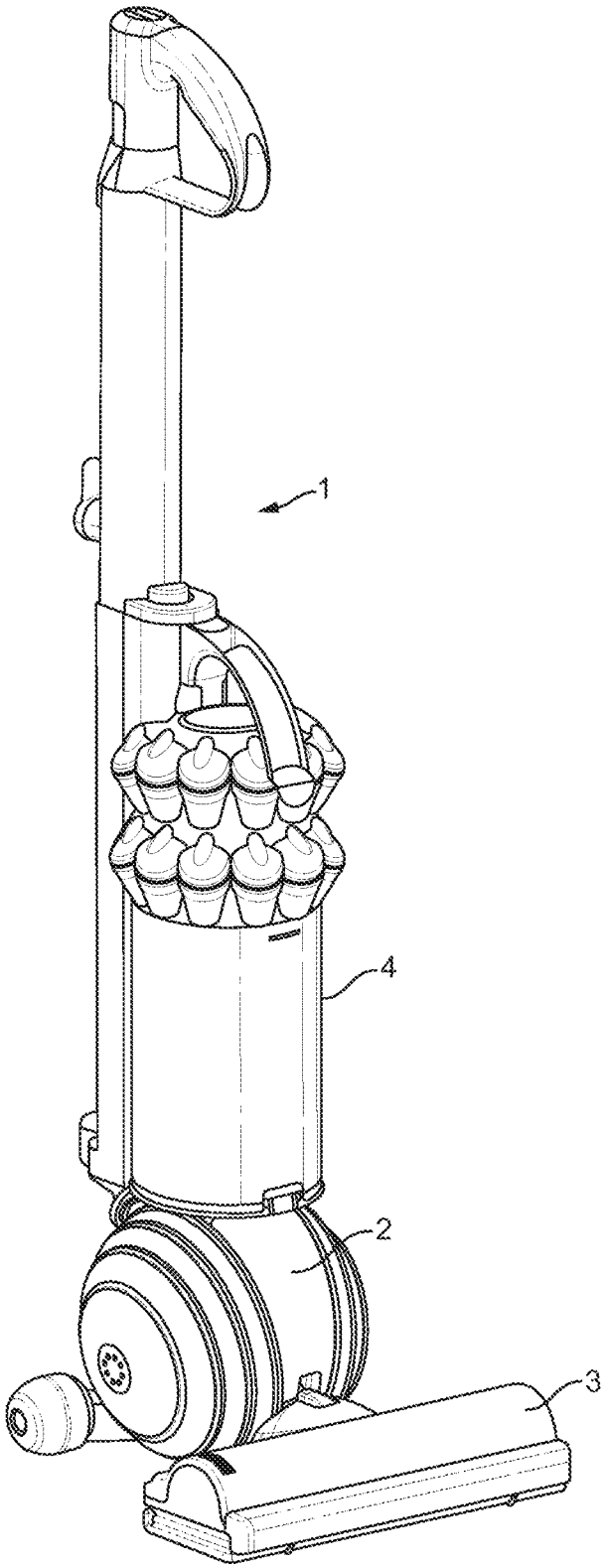
FIG. 1 is a perspective view of an upright vacuum cleaner in accordance with the present invention.
Figure 2:
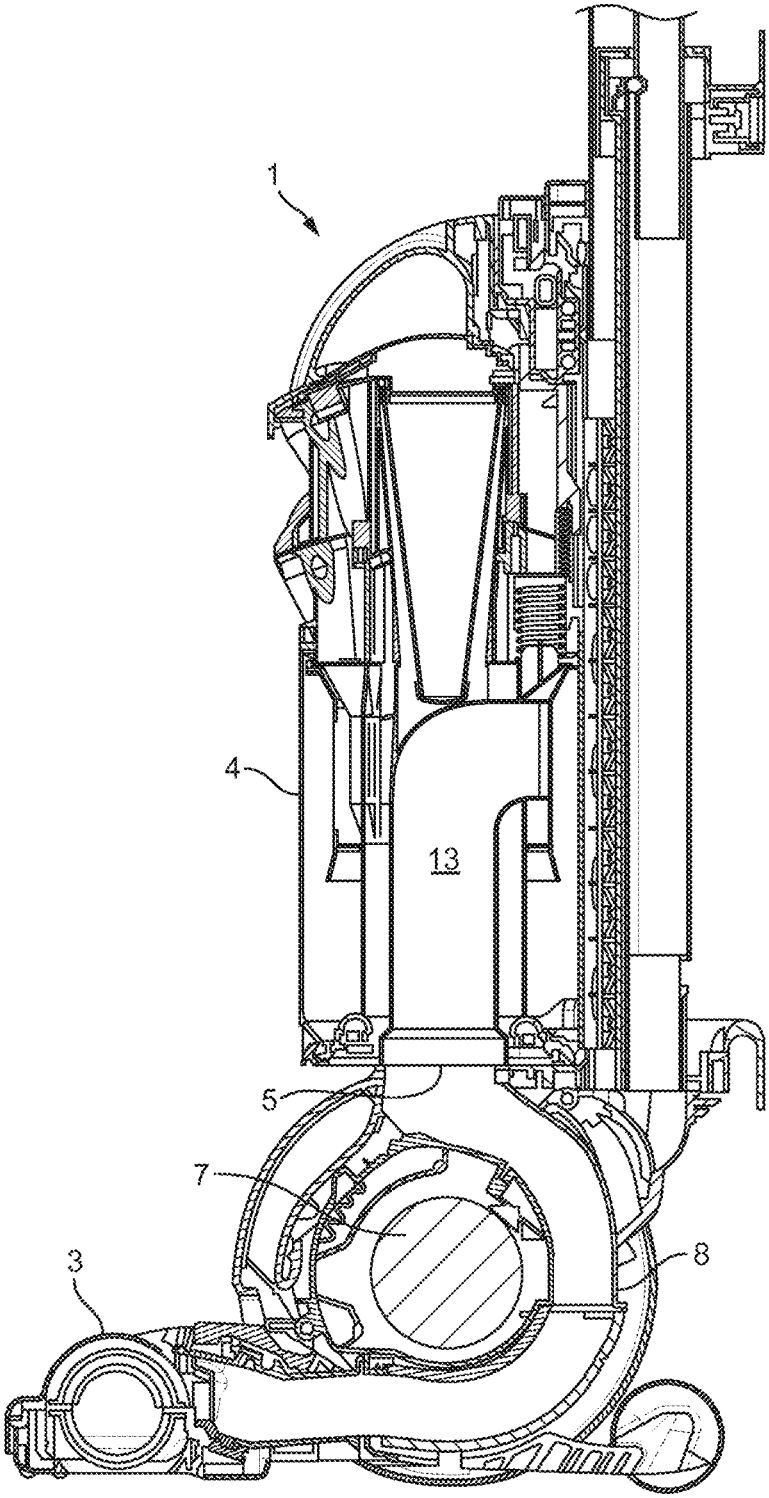
FIG. 2 is a sectional side view of the upright vacuum cleaner.
Figure 3:
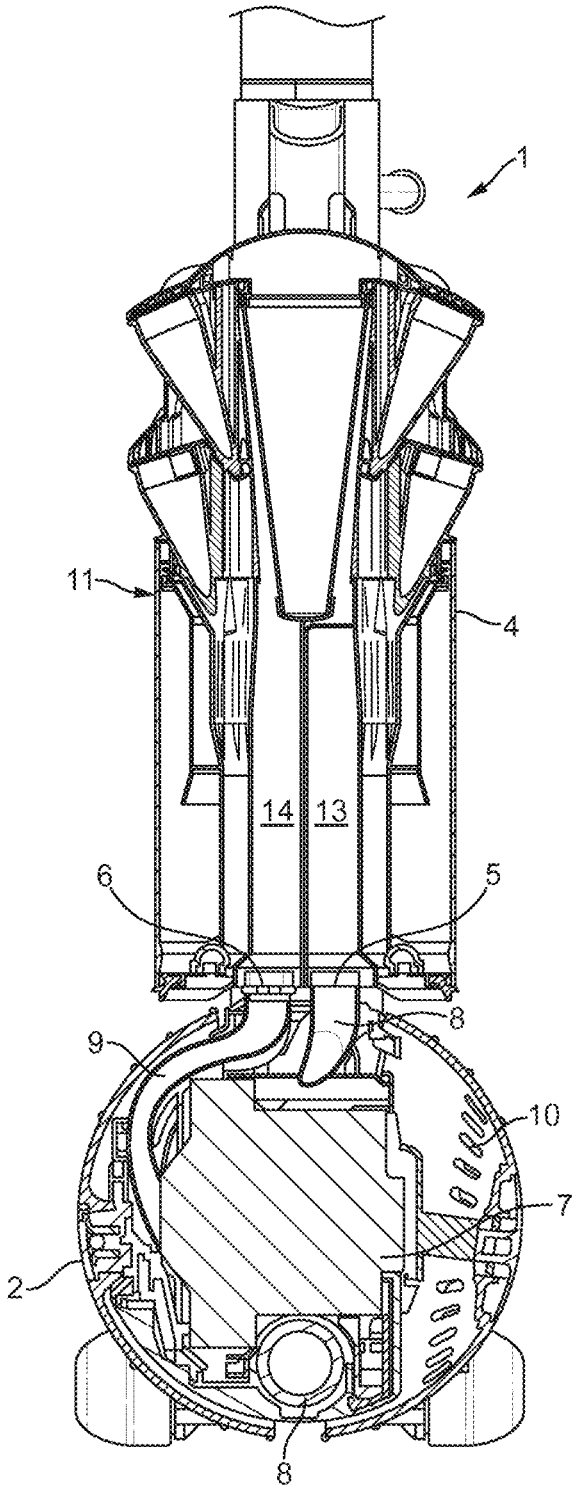
FIG. 3 is a sectional front view of the upright vacuum cleaner.

The upright vacuum cleaner 1 of FIGS. 1 to 3 comprises a main body 2 to which are mounted a cleaner head 3 and a cyclonic separator 4. The cyclonic separator 4 is removable from the main body 2 such that dirt collected by the separator 4 may be emptied. The main body 2 comprises a suction source 7, upstream ducting 8 that extends between the cleaner head 3 and an inlet 5 of the cyclonic separator 4, and downstream ducting 9 that extends between an outlet 6 of the cyclonic separator 4 and the suction source 7. The suction source 7 is thus located downstream of the cyclonic separator 4, which in turn is located downstream of the cleaner head 3.

The suction source 7 is mounted within the main body 2 at a location below the cyclonic separator 4. Since the suction source 7 is often relatively heavy, locating the suction source 7 below the cyclonic separator 4 provides a relatively low centre of gravity for the vacuum cleaner 1. As a result, the stability of the vacuum cleaner 1 is improved. Additionally, handling and manoeuvring of the vacuum cleaner 1 are made easier.

In use, the suction source 7 draws dirt-laden fluid in through a suction opening of the cleaner head 3, through the upstream ducting 8 and into the inlet 5 of the cyclonic separator 4. Dirt is then separated from the fluid and retained within the cyclonic separator 4. The cleansed fluid exits the cyclonic separator 4 via the outlet 6, passes through the downstream ducting 9 and into the suction source 7. From the suction source 7, the cleansed fluid is exhausted from the vacuum cleaner 1 via vents 10 in the main body 2.

Figure 4:
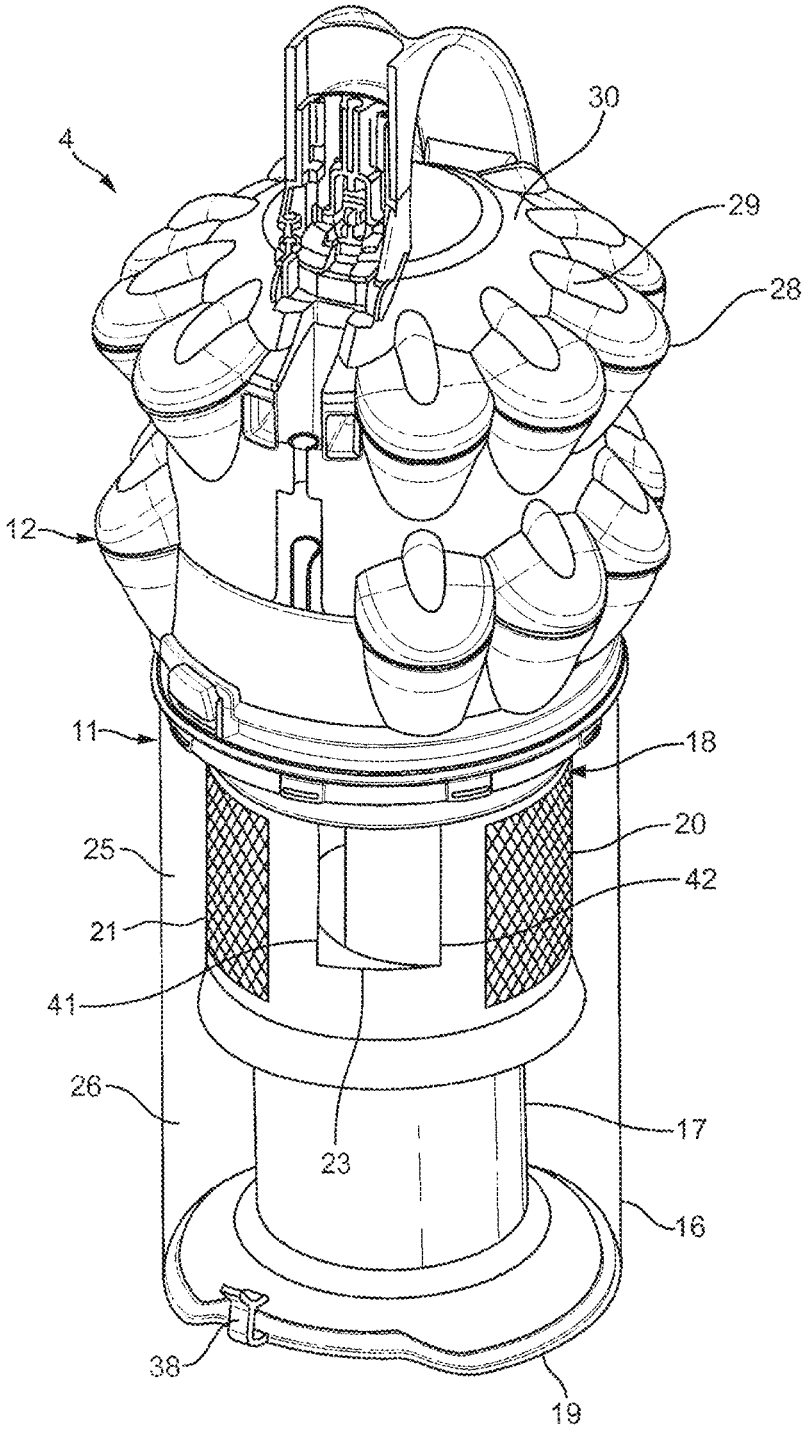
FIG. 4 is a perspective view of the cyclonic separator of the upright vacuum cleaner.
Figure 5:
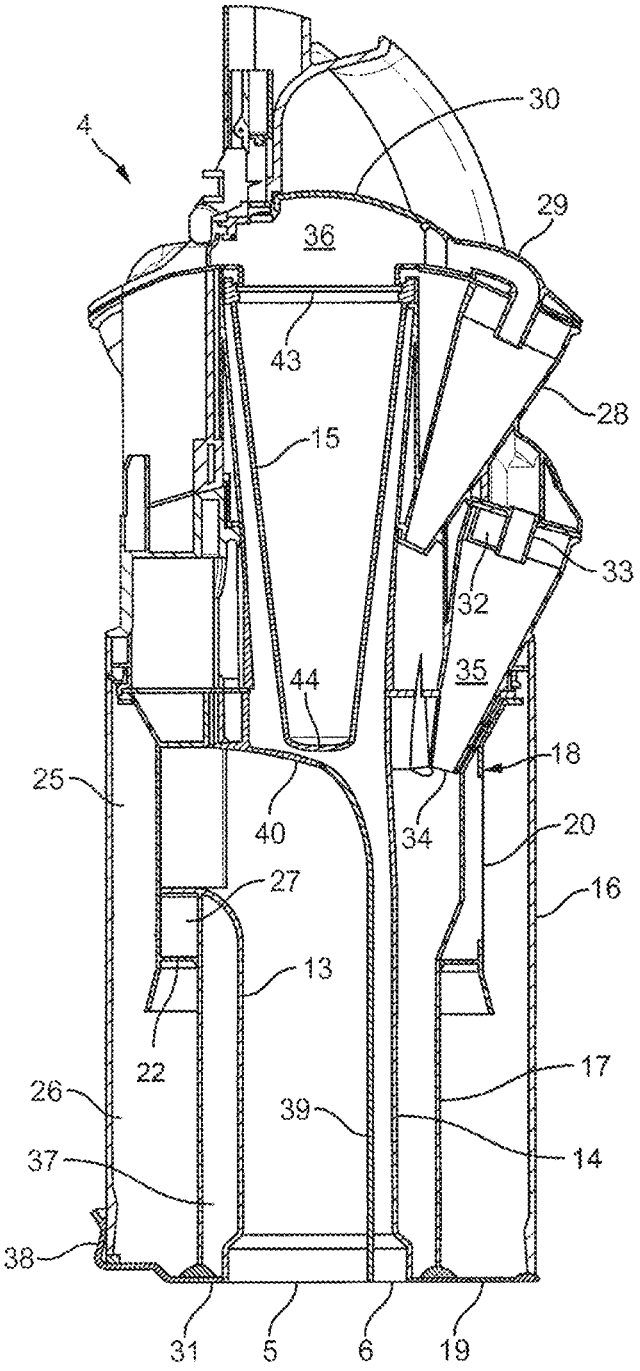
FIG. 5 is a sectional side view of the cyclonic separator of the upright vacuum cleaner.
Figure 6:
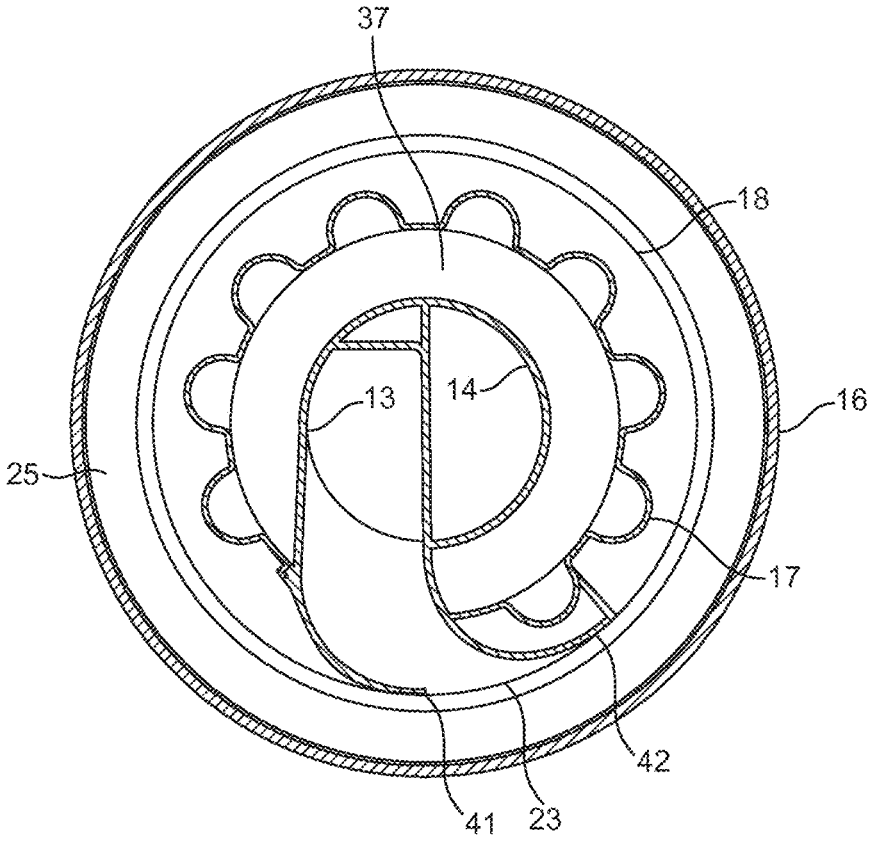
FIG. 6 is a sectional plan view of the cyclonic separator of the upright vacuum cleaner.

Referring now to FIGS. 4 to 6, the cyclonic separator 4 comprises a first cyclone stage 11, a second cyclone stage 12 located downstream of the first cyclone stage 11, an inlet duct 13 for carrying fluid from the inlet 5 to the first cyclone stage 11, an outlet duct 14 for carrying fluid from the second cyclone stage 12 to the outlet 6, and a filter 15.

The first cyclone stage 11 comprises an outer side wall 16, an inner side wall 17, a shroud 18 located between the outer and inner side walls 16,17, and a base 19.

The outer side wall 16 is cylindrical in shape and surrounds the inner side wall 17 and the shroud 18. The inner side wall 17 is generally cylindrical in shape and is arranged concentrically with the outer side wall 16. The upper part of the inner side wall 17 is fluted, as can be seen in FIG. 6. As explained below, the flutes provide passageways along which dirt separated by the cyclones bodies 28 of the second cyclone stage 12 are guided to a dirt collection chamber 37.

The shroud 18 comprises a circumferential wall 20, a mesh 21 and a brace 22. The wall 20 has a flared upper section, a cylindrical central section, and a flared lower section. The wall 20 includes a first aperture that defines an inlet 23 and a second larger aperture that is covered by the mesh 21. The shroud 18 is secured to the inner side wall 17 by the brace 22, which extends between a lower end of the central section and the inner side wall 17.

The upper end of the outer side wall 16 is sealed against the upper section of the shroud 18. The lower end of the outer side wall 16 and the lower end of the inner side 17 wall are sealed against and closed off by the base 19. The outer side wall 16, the inner side wall 17, the shroud 18 and the base 19 thus collectively define a chamber. The upper part of this chamber (i.e. that part generally defined between the outer side wall 16 and the shroud 18) defines a cyclone chamber 25, whilst the lower part of the chamber (i.e. that part generally defined between the outer side wall 16 and the inner side wall 17) defines a dirt collection chamber 26. The first cyclone stage 11 therefore comprises a cyclone chamber 25 and a dirt collection chamber 26 located below the cyclone chamber 25.

Fluid enters the cyclone chamber 25 via the inlet 23 in the shroud 18. The mesh 21 of the shroud 18 comprises a plurality of perforations through which fluid exits the cyclone chamber 25. The shroud 18 therefore serves as both an inlet and an outlet for the cyclone chamber 25. Owing to the location of the inlet 23, fluid is introduced into an upper part of the cyclone chamber 25. During use, dirt may accumulate on the surface of the mesh 21, thereby restricting the flow of fluid through the cyclonic separator 4. By introducing fluid into an upper part of the cyclone chamber 25, fluid spirals downwardly within the cyclone chamber 25 and helps to sweep dirt off the mesh 21 and into the dirt collection chamber 26.

The space between the shroud 18 and the inner side wall 17 defines a fluid passageway 27 that is closed at a lower end by the brace 22. The fluid passageway 27 is open at an upper end and provides an outlet for the first cyclone stage 11.

The second cyclone stage 12 comprises a plurality of cyclone bodies 28, a plurality of guide ducts 29, a manifold cover 30, and a base 31.

The cyclone bodies 28 are arranged as two layers, each layer comprising a ring of cyclone bodies 28. The cyclone bodies 28 are arranged above the first cyclone stage 11, with the lower layer of cyclone bodies 28 projecting below the top of the first cyclone stage 11.

Each cyclone body 28 is generally frusto-conical in shape and comprises a tangential inlet 32, a vortex finder 33, and a cone opening 34. The interior of each cyclone body 28 defines a cyclone chamber 35. Dirt-laden fluid enters the cyclone chamber 35 via the tangential inlet 32. Dirt separated within the cyclone chamber 35 is then discharged through the cone opening 34 whilst the cleansed fluid exits through the vortex finder 33. The cone opening 34 thus serves as a dirt outlet for the cyclone chamber 35, whilst the vortex finder 33 serves as a cleansed-fluid outlet.

The inlet 32 of each cyclone body 28 is in fluid communication with the outlet of the first cyclone stage 11, i.e. the fluid passageway 27 defined between the shroud 18 and the inner side wall 17. For example, the second cyclone stage 12 may comprise a plenum into which fluid from the first cyclone stage 11 is discharged. The plenum then feeds the inlets 32 of the cyclone bodies 28. Alternatively, the second cyclone stage 12 may comprise a plurality of distinct passageways that guide fluid from the outlet of first cyclone stage 11 to the inlets 32 of the cyclone bodies 28.

The manifold cover 30 is dome-shaped and is located centrally above the cyclone bodies 28. The interior space bounded by the cover 30 defines a manifold 36, which serves as an outlet for the second cyclone stage 12. Each guide duct 29 extends between a respective vortex finder 33 and the manifold 36.

The interior space bounded by the inner side wall 17 of the first cyclone stage 11 defines a dirt collection chamber 37 for the second cyclone stage 12. The dirt collection chambers 26,37 of the two cyclone stages 11,12 are therefore adjacent and share a common wall, namely the inner side wall 17. In order to distinguish the two dirt collection chambers 26,37, the dirt collection chamber 26 of the first cyclone stage 11 will hereafter be referred to as the first dirt collection chamber 26, and the dirt collection chamber 37 of the second cyclone stage 12 will hereafter be referred to as the second dirt collection chamber 37.

The second dirt collection chamber 37 is closed off at a lower end by the base 31 of the second cyclone stage 12. As explained below, the inlet duct 13 and the outlet duct 14 both extend through the interior space bounded by the inner side wall 17. Accordingly, the second dirt collection chamber 37 is delimited by the inner side wall 17, the inlet duct 13 and the outlet duct 14.

The cone opening 34 of each cyclone body 28 projects into the second dirt collection chamber 37 such that dirt separated by the cyclone bodies 28 falls into the second dirt collection chamber 37. As noted above, the upper part of the inner side wall 17 is fluted. The flutes provide passageways along which dirt separated by the lower layer of cyclones bodies 28 is guided to the second dirt collection chamber 37; this is perhaps best illustrated in FIG. 5. Without the flutes, a larger diameter would be required for the inner side wall 17 in order to ensure that the cone openings 34 of the cyclone bodies 28 project into the second dirt collection chamber 37.

The base 31 of the second cyclone stage 12 is formed integrally with the base 19 of the first cyclone stage 11. Moreover, the common base 19,31 is pivotally mounted to the outer side wall 16 and is held closed by a catch 38. Upon releasing the catch 38, the common base 19,31 swings open such that the dirt collection chambers 26,37 of the two cyclone stages 11,12 are emptied simultaneously.

The inlet duct 13 extends upwardly from the inlet 5 in the base of the cyclonic separator 4 and through the interior space bounded by the inner side wall 17. At a height corresponding to an upper part of the first cyclone stage 11, the inlet duct 13 turns and extends through the inner side wall 17, through the fluid passageway 27, and terminates at the inlet 23 of the shroud 18. The inlet duct 13 therefore carries fluid from the inlet 5 in the base of the cyclonic separator 4 to the inlet 23 in the shroud 18.

The inlet duct 13 may be regarded as having a lower first section 39 and an upper second section 40. The first section 39 is generally straight and extends axially (i.e. in a direction parallel to the longitudinal axis of the cyclone chamber 25) through the interior space bounded by the inner side wall 17. The second section 40 comprises a pair of bends. The first bend turns the inlet duct 13 from axial to generally radial (i.e. in a direction generally normal to the longitudinal axis of the cyclone chamber 25). The second bend turns the inlet duct 13 in a direction about the longitudinal axis of the cyclone chamber 25. The first section 39 therefore carries fluid axially through the cyclonic separator 4, whilst the second section 40 turns and introduces the fluid into the cyclone chamber 25.

Since the inlet duct 13 terminates at the inlet 23 of the shroud 18, it is not possible for the inlet duct 13 to introduce fluid tangentially into the cyclone chamber 25. Nevertheless, the downstream end of the inlet duct 13 turns the fluid sufficiently that cyclonic flow is achieved within the cyclone chamber 25. Some loss in fluid speed may be experienced as the fluid enters the cyclone chamber 25 and collides with the outer side wall 16. In order to compensate for this loss in fluid speed, the downstream end of the inlet duct 13 may decrease in cross-sectional area in a direction towards the inlet 23. As a result, fluid entering the cyclone chamber 25 is accelerated by the inlet duct 13.

Fluid within the cyclone chamber 25 is free to spiral about the shroud 18 and over the inlet 23. The juncture of the inlet duct 13 and the shroud 18 may be regarded as defining an upstream edge 41 and a downstream edge 42 relative to the direction of fluid flow within the cyclone chamber 25. That is to say that fluid spiralling within the cyclone chamber 25 first passes the upstream edge 41 and then the downstream edge 42. As noted above, the downstream end of the inlet duct 13 curves about the longitudinal axis of the cyclone chamber 25 such that fluid is introduced into the cyclone chamber 25 at an angle that encourages cyclonic flow. Additionally, the downstream end of the inlet duct 13 is shaped such the upstream edge 41 is sharp and the downstream edge 42 is rounded or blended. As a result, fluid entering the cyclone chamber 25 is turned further by the inlet duct 13. In particular, by having a rounded downstream edge 42, fluid is encouraged to follow the downstream edge 42 by means of the Coanda effect.

The outlet duct 14 extends from the manifold 36 of the second cyclone stage 12 to the outlet 6 in the base of the cyclonic separator 4. The outlet duct 14 extends through a central region of the cyclonic separator 4 and is surrounded by both the first cyclone stage 11 and the second cyclone stages 12.

The outlet duct 14 may be regarded as having a lower first section and an upper second section. The first section of the outlet duct 14 and the first section 39 of the inlet duct 13 are adjacent and share a common wall. Moreover, the first section of the outlet duct 14 and the first section 39 of the inlet duct 13 each have a cross-section that is generally D-shaped. Collectively, the first sections of the two ducts 13,14 form a cylindrical element that extends upwardly through the interior space bound by the inner side wall 17; this is best illustrated in FIGS. 3 and 6. The cylindrical element is spaced from the inner side wall 17 such that the second dirt collection chamber 37, which is delimited by the inner side wall 17, the inlet duct 13 and the outlet duct 14, has a generally annular cross-section. The second section of the outlet duct 14 has a circular cross-section.

The filter 15 is located in the outlet duct 14 and is elongated in shape. More particularly, the filter 15 comprises a hollow tube having an open upper end 43 and a closed lower end 44. The filter 15 is located in the outlet duct 14 such that fluid from the second cyclone stage 12 enters the hollow interior of the filter 15 via the open end 43 and passes through the filter 15 into the outlet duct 14. Fluid therefore passes through the filter 15 before being discharged through the outlet 6 in the base of the cyclonic separator 4.

The cyclonic separator 4 may be regarded as having a central longitudinal axis that is coincident with the longitudinal axis of the cyclone chamber 25 of the first cyclone stage 11. The cyclone bodies 28 of the second cyclone stage 12 are then arranged about this central axis. The outlet duct 14 and the first section 39 of the inlet duct 13 then extend axially (i.e. in a direction parallel to the central axis) through the cyclonic separator 4.

In use, dirt-laden fluid is drawn into the cyclonic separator 4 via the inlet 5 in the base of the cyclonic separator 4. From there, the dirt-laden fluid is carried by the inlet duct 13 to the inlet 23 in the shroud 18. The dirt-laden fluid then enters the cyclone chamber 25 of the first cyclone stage 11 via the inlet 23. The dirt-laden fluid spirals about the cyclone chamber 25 causing coarse dirt to be separated from the fluid. The coarse dirt collects in the dirt collection chamber 26, whilst the partially cleansed fluid is drawn through the mesh 21 of the shroud 18, up through the fluid passageway 27, and into the second cyclone stage 12. The partially cleansed fluid then divides and is drawn into the cyclone chamber 35 of each cyclone body 28 via the tangential inlet 32. Fine dirt separated within the cyclone chamber 35 is discharged through the cone opening 34 and into the second dirt collection chamber 37. The cleansed fluid is drawn up through the vortex finder 33 and along a respective guide duct 29 to the manifold 36. From there, the cleansed fluid is drawn into the interior of the filter 15. The fluid passes through the filter 15, which acts to removes any residual dirt from the fluid, and into the outlet duct 14. The cleansed fluid is then drawn down the outlet duct 14 and out through the outlet 6 in the base of the cyclonic separator 4.

The cleaner head 3 of the vacuum cleaner 1 is located below the cyclonic separator 4. By having an inlet 5 located at the base of the cyclonic separator 4, a less tortuous path may be taken by the fluid between the cleaner head 3 and the cyclonic separator 4. Since a less tortuous path may be taken by the fluid, an increase in airwatts may be achieved. Similarly, the suction source 7 is located below the cyclonic separator 4. Accordingly, by having an outlet 6 located at the base of the cyclonic separator 4, a less tortuous path may be taken by the fluid between the cyclonic separator 4 and the suction source 7. As a result, a further increase in airwatts may be achieved.

Since the inlet duct 13 and the outlet duct 14 are located within a central region of the cyclonic separator 4, there is no external ducting extending along the length of the cyclonic separator 4. Accordingly, a more compact vacuum cleaner 1 may be realised.

In extending through the interior of the cyclonic separator 4, the volume of the second dirt collection chamber 37 is effectively reduced by the inlet duct 13 and the outlet duct 14. However, the second cyclone stage 12 is intended to remove relatively fine dirt from the fluid. Accordingly, it is possible to sacrifice part of the volume of the second dirt collection chamber 37 without significantly reducing the overall dirt capacity of the cyclonic separator 4.

The first cyclone stage 11 is intended to remove relatively coarse dirt from the fluid. By having a first dirt collection chamber 26 that surrounds the second dirt collection chamber 37, the inlet duct 13 and the outlet duct 14, a relatively large volume may be achieved for the first dirt collection chamber 26. Moreover, since the first dirt collection chamber 26 is outermost, where the outer diameter is greatest, a relatively large volume may be achieved whilst maintaining a relatively compact overall size for the cyclonic separator 4.

By locating the filter 15 within the outlet duct 14, further filtration of the fluid is achieved without any significant increase in the overall size of the cyclonic separator 4. Since the outlet duct 14 extends axially through the cyclonic separator 4, an elongated filter 15 having a relatively large surface area may be employed.

Figure 7:
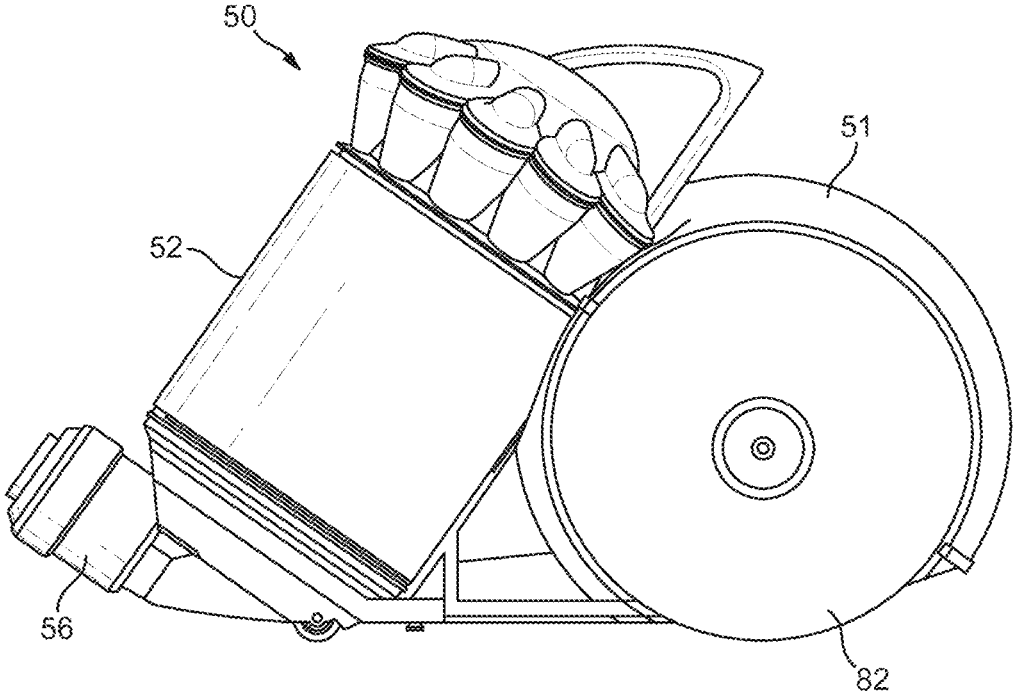
FIG. 7 is a side view of a canister vacuum cleaner in accordance with the present invention.
Figure 8:
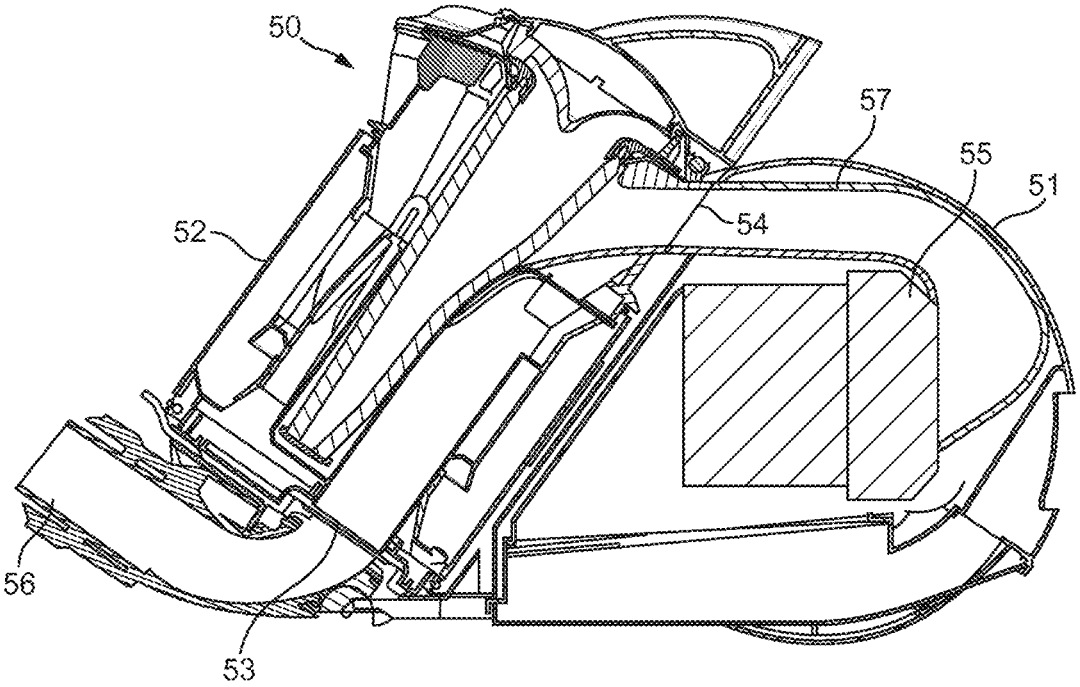
FIG. 8 is a sectional side view of the canister vacuum cleaner.

The canister vacuum cleaner 50 of FIGS. 7 and 8 comprises a main body 51 to which a cyclonic separator 52 is removably mounted. The main body 51 comprises a suction source 55, upstream ducting 56 and downstream ducting 57. One end of the upstream ducting 56 is coupled to an inlet 53 of the cyclonic separator 52. The other end of the upstream ducting 56 is intended to be coupled to a cleaner head by means of, for example, a hose-and-wand assembly. One end of the downstream ducting 57 is coupled at an outlet 54 of the cyclonic separator 52, and the other end is coupled to the suction source 55. The suction source 55 is therefore located downstream of the cyclonic separator 52, which in turn is located downstream of the cleaner head.

Figure 9:
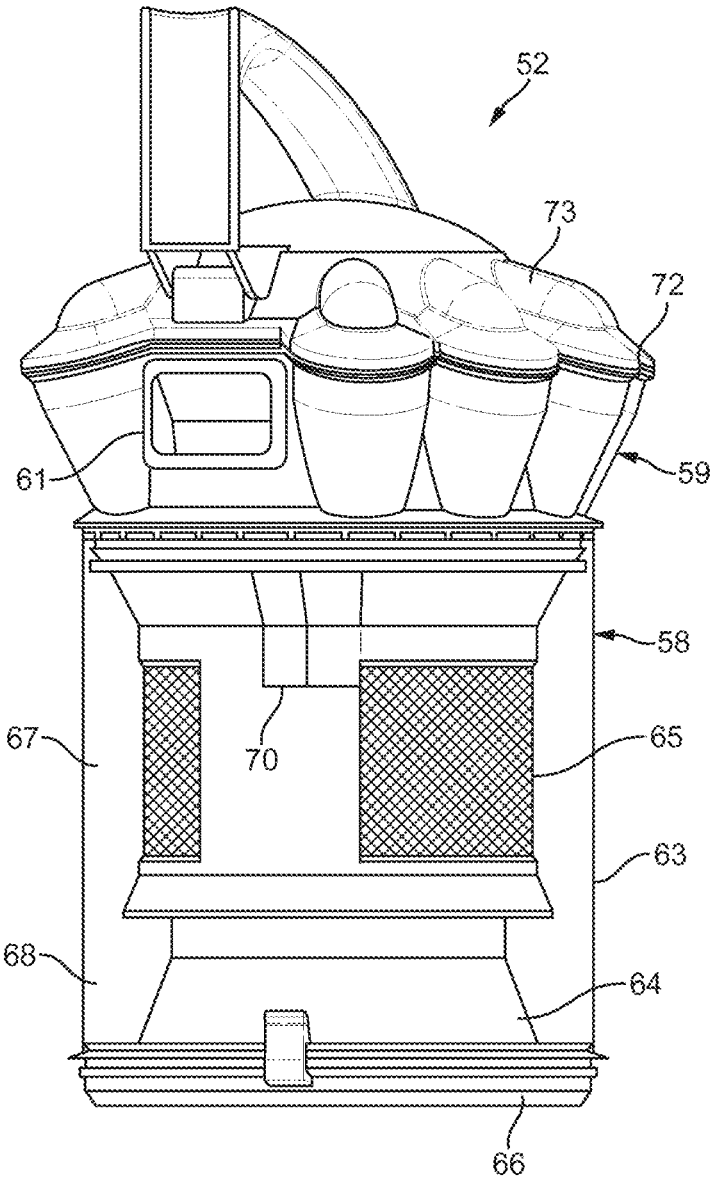
FIG. 9 is a side view of the cyclonic separator of the canister vacuum cleaner.
Figure 10:
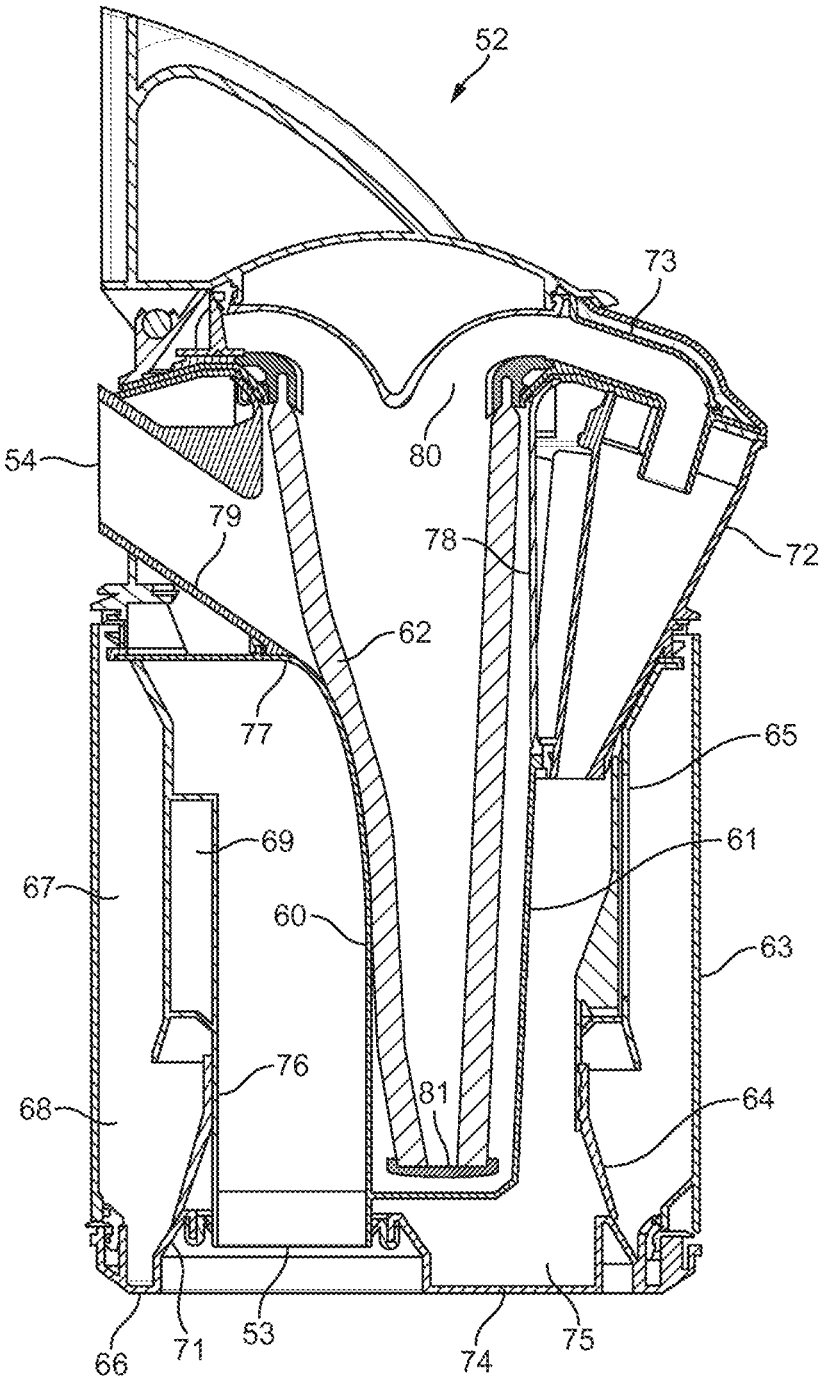
FIG. 10 is a sectional side view of the cyclonic separator of the canister vacuum cleaner.
Figure 11:
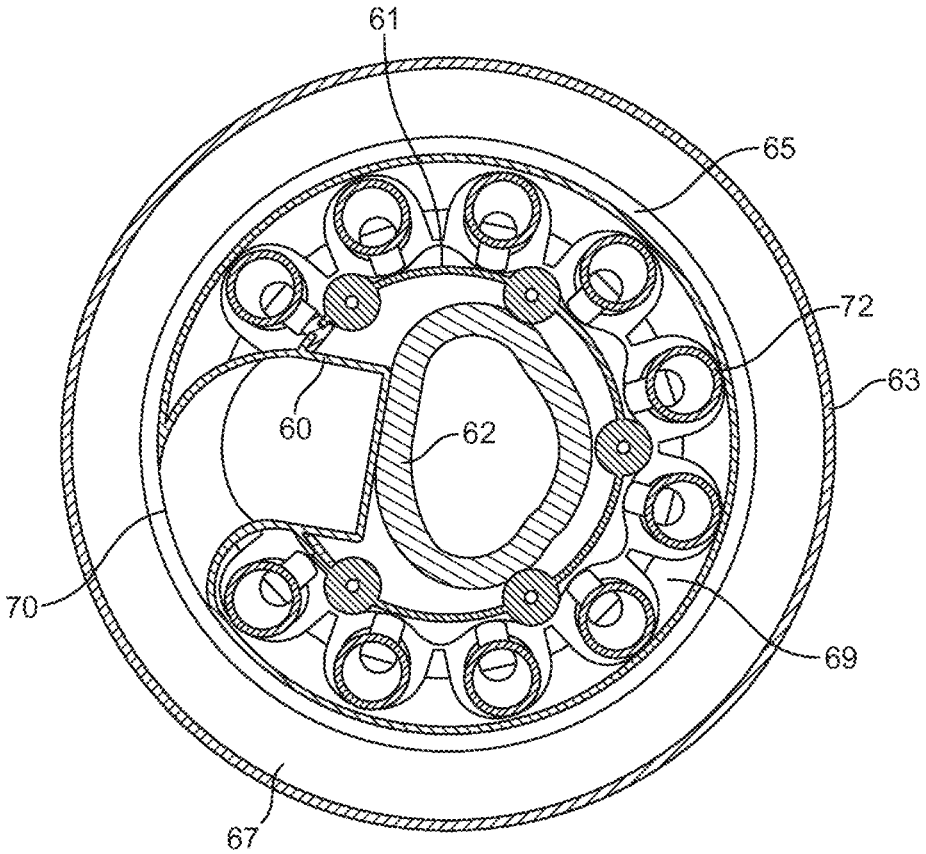
FIG. 11 is a sectional plan view of the cyclonic separator of the canister vacuum cleaner.

Referring now to FIGS. 9 to 11, the cyclonic separator 52 is identical in many respects to that described above and illustrated in FIGS. 4 to 6. In particular, the cyclonic separator 52 comprises a first cyclone stage 58, a second cyclone stage 59 located downstream of the first cyclone stage 58, an inlet duct 60 for carrying fluid from the inlet 53 to the first cyclone stage 58, an outlet duct 61 for carrying fluid from the second cyclone stage 59 to the outlet 54, and a filter 62. In view of the similarity between the two cyclonic separators 4,52, a full description of the cyclonic separator 52 will not be repeated. Instead, the following paragraphs will concentrate primarily on the differences that exist between the two cyclonic separators 4,52.

The first cyclone stage 58, like that previously described, comprises an outer side wall 63, an inner side wall 64, a shroud 65 and a base 66, which collectively define a cyclone chamber 67 and a dirt collection chamber 68. With the cyclonic separator 4 of FIGS. 4 to 6, the base 19 of first cyclone stage 11 comprises a seal that seals against the inner side wall 17. With the cyclonic separator 52 of FIGS. 9 to 11, the lower part of the inner side wall 64 is formed of a flexible material which then seals against an annual ridge 71 formed in the base 66 of the first cyclone stage 58. Otherwise, the first cyclone stage 58 is essentially unchanged from that described above.

The second cyclone stage 59, again like that previously described, comprises a plurality of cyclone bodies 72, a plurality of guide ducts 73, and a base 74. The second cyclone stage 12 illustrated in FIGS. 4 to 6 comprises two layers of cyclone bodies 28. In contrast, the second cyclone stage 59 of FIGS. 9 to 11 comprises a single layer of cyclone bodies 72. The cyclone bodies 72 are themselves unchanged.

The second cyclone stage 12 of the cyclonic separator 4 of FIGS. 4 to 6 comprises a manifold 36, which serves as an outlet of the second cyclone stage 12. Each of the guide ducts 29 of the second cyclone stage 12 then extends between the vortex finder 33 of a cyclone body 28 and the manifold 36. In contrast, the second cyclone stage 59 of the cyclonic separator 52 of FIGS. 9 to 11 does not comprise a manifold 36. Instead, the guide ducts 73 of the second cyclone stage 59 meet in the centre at the top of the second cyclone stage 59 and collectively define the outlet of the second cyclone stage 59.

The inlet duct 60 again extends upwardly from an inlet 53 in the base of the cyclonic separator 52 and through the interior space bounded by the inner side wall 64. However, the first section 76 of the inlet duct 60 (i.e. that section which extends axially through the interior space) is not spaced from the inner side wall 64. Instead the first section 76 of the inlet duct 60 is formed integrally with the inner side wall 64. Accordingly, the first section 76 of the inlet duct 60 is formed integrally with both the inner side wall 64 and the outlet duct 61. Owing to the locations of the inlet duct 60 and the outlet duct 61, the second dirt collection chamber 75 may be regarded as C-shaped in cross-section. Otherwise, the inlet duct 60 is largely unchanged from that described above and illustrated in FIGS. 4 to 6.

The most significant differences between the two cyclonic separators 4,52 resides in the locations of the outlets 6,54 and the shapes of the outlet ducts 14,61. Unlike the cyclonic separator 4 of FIGS. 4 to 6, the outlet 54 of the cyclonic separator 52 of FIGS. 9 to 11 is not located in the base of the cyclonic separator 52. Instead, as will now be explained, the outlet 54 is located at an upper part of the cyclonic separator 52.

The outlet duct 61 of the cyclonic separator 52 comprises a first section 78 and a second section 79. The first section 78 extends axially through the cyclonic separator 52. More particularly, the first section 78 extends from an upper part to a lower part of the cyclonic separator 52. The first section 78 is open at an upper end and is closed at a lower end. The second section 79 extends outwardly from an upper part of the first section 78 to between two adjacent cyclone bodies 72. The free end of the second section 79 then serves as the outlet 54 of the cyclonic separator 52.

The filter 62 is essentially unchanged from that described above and illustrated in FIGS. 4 to 6. In particular, the filter 62 is elongated and is located in the outlet duct 61. Again, the filter 62 comprises a hollow tube having an open upper end 80 and a closed lower end 81. Fluid from the second cyclone stage 59 enters the hollow interior of the filter 62, passes through the filter 62 and into the outlet duct 61. Although the outlet 54 of the cyclonic separator 52 is located at a top part of the cyclonic separator 52, the provision of an outlet duct 61 that extends axially through the cyclonic separator 52 provides space in which to house the filter 62. Consequently, an elongated filter 62 having a relatively large surface area may be employed.

The upstream ducting 56 is located at a front end of the vacuum cleaner 50. Moreover, the upstream ducting 56 extends along an axis that is generally perpendicular to the rotational axis of the wheels 82 of the vacuum cleaner 50. Consequently, when a hose is attached to the upstream ducting 56, the vacuum cleaner 50 can be conveniently moved forward by pulling at the hose. By locating the inlet 53 of the cyclonic separator 52 in the base, a less tortuous path may be taken by the fluid when travelling from the hose to the cyclonic separator 52. In particular, it is not necessary for the upstream ducting 56 to bend around the base and then extend along the side of the cyclonic separator 52. As a result, an increase in airwatts may be achieved.

By locating the inlet 53 at the base of the cyclonic separator 52, the vacuum cleaner 50 can be conveniently tilted backwards by pulling upwards on the upstream ducting 56 or a hose attached thereto. Tilting the vacuum cleaner 50 backwards causes the front of the vacuum cleaner 50 to lift off the ground so that the vacuum cleaner 50 is supported by the wheels 82 only. This then allows the vacuum cleaner 50 to be manoeuvred over bumps or other obstacles on the floor surface.

The cyclonic separator 52 is mounted to the main body 51 such that the base of the cyclonic separator 52 is directed towards the front of the vacuum cleaner 50, i.e. the cyclonic separator 52 is tilted from vertical in a direction which pushes the base of the cyclonic separator 52 towards the front of the vacuum cleaner 50. Directing the base of the cyclonic separator 52 towards the front of the vacuum cleaner 50 reduces the angle through which the fluid is turned by the upstream ducting 56.

The suction source 55 is not located below the cyclonic separator 52; that is to say that the suction source 55 is not located below the base of the cyclonic separator 52. It is for this reason that the outlet 54 of the cyclonic separator 52 is not located in the base. Instead, the outlet 54 is located at an upper part of the cyclonic separator 52. As a result, a shorter and less tortuous path may be taken by the fluid between the cyclonic separator 52 and the suction source 55.

In having an outlet duct 61 that extends between two of the cyclone bodies 72, a more compact cyclonic separator 52 may be realised. For known cyclonic separators having a ring of cyclone bodies, fluid is often discharged into a manifold located above the cyclone bodies. The outlet of the cyclonic separator is then located in a wall of the manifold. In contrast, with the cyclonic separator 52 of FIGS. 9 to 11, fluid is discharged from the cyclone bodies 72 into a first section 78 of the outlet duct 61, about which the cyclone bodies 72 are arranged. A second section 79 of the outlet duct 61 then extends outwardly from the first section 78 to between two of the cyclone bodies 72. As a result, the manifold may be omitted and thus the height of the cyclonic separator 52 may be reduced. In conventional cyclonic separators, the central space around which the cyclone bodies are arranged is often unutilised. The cyclonic separator 52 of FIGS. 9 to 11, on the other hand, makes use of this space to locate the first section 78 of the outlet duct 61. The second section 79 of the outlet duct 61 then extends outwardly from the first section 78 to between the two cyclone bodies 72. In making use of the otherwise unutilised space, the height of the cyclonic separator 52 may be reduced without compromising on performance.

In order to further reduce the height of the cyclonic separator 52, the cyclone bodies 72 of the second cyclone stage 59 project below the top of the first cyclone stage 58. As a consequence, the shroud 65 and the cyclone chamber 67 surround the lower ends of the cyclone bodies 72. The inlet duct 60 then extends between the same two cyclone bodies as that of the outlet duct 61. As a result, fluid may be introduced into an upper part of the cyclone chamber 67 without the need to increase the height of the cyclonic separator 52.

As with the cyclonic separator 4 of FIGS. 4 to 6, the inlet duct 60 and the outlet duct 61 extend through the interior of the cyclonic separator 52. Accordingly, there is no external ducting extending along the length of the cyclonic separator 52 and thus a more compact vacuum cleaner 50 may be realised.

In each of the embodiments described above, fluid from the second cyclone stage 12,59 enters the hollow interior of the filter 15,62. The fluid then passes through the filter 15,62 and into the outlet duct 14,61. By directing the fluid into the hollow interior of the filter 15,62, the fluid acts to inflate the filter 15,62 and thus prevents the filter 15,62 from collapsing. Consequently, it is not necessary for the filter 15,62 to include a frame or other support structure in order to retain the shape of the filter 15,62. Nevertheless, if desired or indeed required, the filter 15,62 may include a frame or other support structure. By providing a frame or support structure, the direction of fluid through the filter 15,62 may be reversed.

In the embodiments described above, the inlet duct 13,60 and the outlet duct 14,61 are adjacent one another. Conceivably, however, the inlet duct 13,60 may be nested within the outlet duct 14.61. For example, the first section 39,76 of the inlet duct 13,60 may extend axially within the outlet duct 14,61. The second section 40,77 of the inlet duct 13,60 then turns and extends through the wall of the outlet duct 14,61 and into the first cyclone stage 11,58. Alternatively, the lower part of the outlet duct 14,61 may be nested within the inlet duct 13,60. As the inlet duct 13,60 turns from axial to radial, the outlet duct 14,61 then extends upwardly through the wall of the inlet duct 13,60.

The first dirt collection chamber 26,68 is delimited by the outer side wall 16,63 and the inner side wall 17,64, and the second dirt collection chamber 37,75 is delimited by the inner side wall 17,64, the inlet duct 13,60 and the outlet duct 14,61. However, in the embodiment illustrated in FIGS. 9 to 11, the outlet duct 61 may be shorter such that the second dirt collection chamber 75 is delimited by the inner side wall 64 and the inlet duct 60 only. Moreover, for the situation described in the preceding paragraph in which the inlet duct 13,60 and outlet duct 14,61 are nested, the second dirt collection chamber 37,75 is delimited by the inner side wall 17,64 and one only of the inlet duct 13,60 and the outlet duct 14,61.

In each of the embodiments described above, the outlet duct 14,61 extends axially through the cyclonic separator 4,52. In the embodiment illustrated in FIGS. 4 to 6, the outlet duct 14 extends to an outlet 6 located in the base of the cyclonic separator 4. In the embodiment illustrated in FIGS. 9 to 11, the outlet duct 61 stops short of the base. In having an outlet duct 14,61 that extends axially through the cyclonic separator 4,52, adequate space is provided for a relatively long filter 15,62. However, it is not essential that the outlet duct 14,61 extends axially through the cyclonic separator 4,52 or that a filter 15,62 is employed in the cyclonic separator 4,52. Irrespective of whether the outlet duct 14,61 extends axially through the cyclonic separator 4,52 or whether a filter 15,62 is employed, the cyclonic separator 4,52 continues to exhibit many of the advantages described above, e.g. a less tortuous path between the cleaner head and the inlet 5,53 of the cyclonic separator 4,52, and a more compact cyclonic separator 4,52 with no external ducting extending to the inlet 5,53.

In order to conserve both space and materials, part of the inlet duct 13,60 is formed integrally with the outlet duct 14,61. Part of the inlet duct 13,60 may also be formed integrally with the inner side wall 17,64 and/or the shroud 18,65. In reducing the amount of material required for the cyclonic separator 4,52, the cost and/or weight of the cyclonic separator 4,52 are reduced. Nevertheless, if required (e.g. in order to simplify manufacture or assembly of the cyclonic separator 4,52), the inlet duct 13,60 may be formed separately from the outlet duct 14,61, the inner side wall 17,64 and/or the shroud 18,65.

In the embodiments described above, the first dirt collection chamber 26,68 completely surrounds the second dirt collection chamber 37,75, as well as the inlet duct 13,60 and the outlet duct 14,61. However, an alternative vacuum cleaner may place constraints on the shape of the cyclonic separator 4,52 and in particular the shape of the first dirt collection chamber 26,68. For example, it may be necessary to have a first dirt collection chamber 26,68 that is C-shaped. In this instance, the first dirt collection chamber 26,68 no longer completely surrounds the second dirt collection chamber 37,75, the inlet duct 13,60 and the outlet duct 14,61. Nevertheless the first dirt collection chamber 26,68 surrounds at least partly the second dirt collection chamber 37,75, the inlet duct 13,60 and the outlet duct 14,61, which are all located inwardly of the first dirt collection chamber 26,68.

In each of the embodiments described above, fluid is introduced into the cyclone chamber 25,67 of the first cyclone stage 11,58 via an inlet 23,70 formed in a wall of the shroud 18,65. This arrangement has led to improvements in separation efficiency when compared with a conventional cyclone chamber having a tangential inlet located at the outer side wall. At the time of writing, the mechanisms responsible for the improvement in separation efficiency are not fully understood. For a conventional cyclone chamber having a tangential inlet at the outer side wall, increased abrasion has been observed on the side of the shroud at which fluid is introduced into the cyclone chamber. It is therefore believed that the shroud presents a first line-of-sight for fluid introduced into the cyclone chamber. As a result, part of the fluid entering the cyclone chamber first impacts the surface of the shroud rather than the outer side wall. Impacting the surface in this manner means that dirt entrained in the fluid has little opportunity to separate in the cyclone chamber. Consequently, dirt smaller than the shroud perforations will pass immediately through the shroud and will not experience any separation, thereby resulting in a drop in separation efficiency. With the cyclonic separators 4,52 described above, the inlet 23,70 to the cyclone chamber 25,67 is located at a surface of the shroud 18,65. As a result, fluid is introduced into the cyclone chamber 25,67 in a direction away from the shroud 18,65. Consequently, the first line-of-sight for the fluid is the outer side wall 16,63. The direct route through the shroud 18,65 is therefore eliminated and thus there is a net increase in separation efficiency.

It is by no means obvious that locating the inlet 23,70 to the cyclone chamber 25,67 at the shroud 18,65 would result in an increase in separation efficiency. The shroud 18,65 comprises a plurality of perforations through which fluid exits the cyclone chamber 25,67. By locating the inlet 23,70 at the shroud 18,65, less area is made available for the perforations. As a result of the decrease in area, fluid passes through the shroud perforations at greater speed. This increase in fluid speed leads to increased dirt re-entrainment, which should result in a drop in separation efficiency. In contrast, however, a net increase in separation efficiency is observed.

Although reference has thus far been made to a shroud 18,65 having a mesh 21, other types of shroud having perforations through which fluid exits the cyclone chamber 25,67 may equally be used. For example, the mesh may be omitted and the perforations may be formed directly in the wall 20 of the shroud 18,65; this type of shroud can be found on many Dyson vacuum cleaners, e.g. DC25.

The invention claimed is:

1. A cyclonic separator comprising a cyclone chamber defined between an outer wall and a shroud, the shroud comprising an inlet opening through which fluid enters the cyclone chamber, and a plurality of perforations through which fluid exits the cyclone chamber, wherein fluid within the cyclone chamber is free to spiral about the shroud and over the inlet opening, wherein at least a portion of the inlet opening is located between the perforations.

2. The cyclonic separator of claim 1, wherein the inlet opening introduces fluid into to an upper part of the cyclone chamber, and the cyclonic separator comprises a dirt collection chamber located below the cyclone chamber.

3. The cyclonic separator of claim 1, wherein the cyclonic separator comprises an inlet duct for carrying fluid to the cyclone chamber, and the inlet duct terminates at the inlet opening.

4. The cyclonic separator of claim 3, wherein the inlet duct comprises a first section for carrying fluid in a direction parallel to a longitudinal axis of the cyclone chamber, and a second section for turning the fluid and introducing the fluid into the cyclone chamber.

5. The cyclonic separator of claim 3, wherein a downstream end of the inlet duct curves about a longitudinal axis of the cyclone chamber.

6. The cyclonic separator of claim 1, wherein a juncture of the inlet duct and the shroud defines an upstream edge and a downstream edge relative to the direction of fluid flow within the cyclone chamber, the upstream edge is sharp and the downstream edge is rounded.

7. The cyclonic separator of claim 3, wherein the inlet duct extends from an opening in a base of the cyclonic separator to the inlet opening.

8. The cyclonic separator of claim 3, wherein a cross-sectional area of the inlet duct decreases in a direction towards the inlet opening.

9. The cyclonic separator of claim 3, wherein at least part of the inlet duct is formed integrally with the shroud.

10. The cyclonic separator of claim 1, wherein the cyclonic separator comprises a first cyclone stage and a second cyclone stage located downstream of the first cyclone stage, the first cyclone stage comprises the cyclone chamber, the second cyclone stage comprises a plurality of cyclone bodies, and the cyclonic separator comprises an inlet duct for carrying fluid to the cyclone chamber, the inlet duct extending between two adjacent cyclone bodies and terminating at the inlet opening.

11. The cyclonic separator of claim 1, wherein the cyclonic separator comprises a first cyclone stage and a second cyclone stage located downstream of the first cyclone stage, the first cyclone stage comprises the cyclone chamber and a first dirt collection chamber located below the cyclone chamber, the second cyclone stage comprises a plurality of cyclone bodies and a second dirt collection chamber, and the first dirt collection chamber surrounds the second dirt collection chamber.

12. The cyclonic separator of claim 11, wherein the cyclonic separator comprises an inlet duct for carrying fluid to the cyclone chamber, the first dirt collection chamber surrounds a lower part of the inlet duct, the shroud surrounds an upper part of the inlet duct, and the inlet duct terminates at the inlet opening.

13. The cyclonic separator of claim 11, wherein the cyclonic separator comprises an outlet duct for carrying fluid from the second cyclone stage, and the first cyclone stage surrounds at least part of the outlet duct.

14. The cyclonic separator of claim 13, wherein the cyclonic separator comprises an elongated filter located in the outlet duct.

15. The cyclonic separator of claim 14, wherein the filter comprises a hollow tube that is open at one end and closed at an opposite end, and fluid from the second cyclone stage enters the interior of the filter via the open end and passes through the filter into the outlet duct.

16. A vacuum cleaner comprising the cyclonic separator of claim 1.

* * * * *